US007950324B2

(12) United States Patent
Doyle et al.

(10) Patent No.: US 7,950,324 B2
(45) Date of Patent: May 31, 2011

(54) STRAP EXCHANGER FOR A STRAPPING SYSTEM

(75) Inventors: David R. Doyle, Aberdeen, WA (US); Gerald A. Ryan, Aberdeen, WA (US)

(73) Assignee: Enterprises International, Inc., Hoquiam, WA (US)

( * ) Notice: Subject to any disclaimer, the term of this patent is extended or adjusted under 35 U.S.C. 154(b) by 273 days.

(21) Appl. No.: 12/254,725

(22) Filed: Oct. 20, 2008

(65) Prior Publication Data

US 2009/0223388 A1 Sep. 10, 2009

Related U.S. Application Data

(60) Provisional application No. 61/068,187, filed on Mar. 4, 2008.

(51) Int. Cl.
*B65B 13/04* (2006.01)
*B65B 13/18* (2006.01)

(52) U.S. Cl. ..... 100/2; 100/26; 100/34; 53/399

(58) Field of Classification Search ..... 100/2, 18, 100/26, 29, 30, 34; 53/399, 589
See application file for complete search history.

(56) References Cited

U.S. PATENT DOCUMENTS

| | | | | |
|---|---|---|---|---|
| 5,299,407 | A | 4/1994 | Schuttler et al. | |
| 7,377,213 | B1 * | 5/2008 | Haberstroh et al. | 100/29 |
| 7,770,369 | B2 * | 8/2010 | Doyle et al. | 53/589 |
| 2004/0200191 | A1 | 10/2004 | Armstrong et al. | |
| 2008/0216449 | A1 | 9/2008 | Zimmerli | |
| 2008/0256900 | A1 | 10/2008 | Doyle et al. | |

FOREIGN PATENT DOCUMENTS

| | | | |
|---|---|---|---|
| WO | 2004067383 | A1 | 8/2004 |
| WO | 2007028262 | A1 | 3/2007 |

* cited by examiner

*Primary Examiner* — Jimmy T Nguyen
(74) *Attorney, Agent, or Firm* — Seed Intellectual Property Law Group PLLC

(57) ABSTRACT

A strapping system includes a strap exchanger that is capable of delivering one or more straps to a component of the strapping system. The strap exchanger feeds a strap to a downstream component of the strapping system. A track assembly receives the strap and uses that strap to bundle product. The strap exchanger is capable of repeatedly delivering straps to the strapping system to reduce, limit, or substantially eliminate downtime associated with manually loading straps into the strapping system.

20 Claims, 16 Drawing Sheets

STRAP EXCHANGER FOR A STRAPPING SYSTEM

CROSS-REFERENCE TO RELATED APPLICATION

This application claims the benefit under 35 U.S.C. §119 (e) of U.S. Provisional Patent Application No. 61/068,187 filed Mar. 4, 2008, where this provisional application is incorporated herein by reference in its entirety.

BACKGROUND

1. Technical Field

The present invention generally relates to strapping systems and methods of loading straps into strapping systems. More particularly, the invention relates to strap exchangers of strapping systems capable of rapidly exchanging straps used to bundle objects.

2. Description of the Related Art

Strapping machines are often used to bundle objects. Strapping machines can apply straps of objects about a stack so as to bundle those objects together. These straps are typically supplied to the strapping machine via a dispenser. When a strap coil carried by the dispenser is depleted, an operator must intervene to replace the depleted strap coil with another strap coil. Depending on the coil size and the dispenser configuration, this exchange process can take up to several minutes while product to be strapped is diverted from the strapping machine. Accordingly, replacing depleted coils may result in a significant amount of machine downtime and reduced production.

Conventional dispensers often include a pair of strap coils. Strap from one of the coils can be delivered to the strapping machine to perform bundling procedures. Once the strapping machine is unable to use the loaded strap (e.g., an insufficient amount of strap is left to perform a bundling procedure), a coil exchanger can provide strap from the other coil to the strapping machine. It therefore becomes unnecessary to stop operation of the strapping machine to exchange coils. Unfortunately, conventional coil exchangers have mechanisms that tend to be complicated and unreliable. For example, existing coil exchangers often have a complicated array of sensors, roller systems, and dual strap paths along which the straps are passed. When one of these components malfunctions, the strapping machine is often turned OFF to replace or perform maintenance on that component, resulting in significant downtime. For example, coil exchangers often include complicated roller systems used to deliver straps along separate paths. The roller system maintains separation between the two straps delivered along two separate paths. If the roller system malfunctions, the straps may be improperly routed through the strapping machine and may cause damage to components of the strapping machine, require operator intervention (e.g., manual rerouting of the strap), and the like.

BRIEF SUMMARY

A strapping system, in some embodiments, includes a strap exchanger that is operable to deliver one or more straps to a component of the strapping system. The strap exchanger feeds a strap to a downstream component of the strapping system. A track assembly ultimately receives the strap and uses that strap to bundle product. The strap exchanger is capable of repeatedly delivering straps to the strapping system to reduce, limit, or substantially eliminate downtime associated with manually loading straps into the strapping system. Additionally, the straps can be delivered along the same path through the strapping system to avoid problems associated with delivering different straps along different paths.

In some embodiments, the strap exchanger includes a strap holder assembly that is repeatedly linearly reciprocated to sequentially load any desired number of straps. The system can also include an accumulator positioned downstream of the strap exchanger. The accumulator is adapted to accumulate at least a portion of the strap positioned upstream of the track assembly. The track assembly receives the strap from the accumulator and bundles objects using the strap.

In some embodiments, a strapping system for bundling objects includes an accumulator, a track assembly, and a strap exchanger. The accumulator is adapted to accumulate at least a portion of a strap. The track assembly is adapted to receive the strap and to bundle objects using the strap. The strap exchanger is operable to deliver the strap to the accumulator.

The strap exchanger, in some embodiments, includes a strap feeding assembly, a strap holder assembly, and a drive mechanism. The strap feeding assembly is adapted to move the strap towards the accumulator. The strap holder assembly is movable between a strap receiving position and a strap delivery position and is movable with respect to the strap feeding assembly. The strap holder assembly has a closed configuration for retaining the strap and an open configuration for releasing the strap. The drive mechanism is operable to move the strap holder assembly from the strap receiving position to the strap delivery position so as to deliver an end of the strap, which is carried by the strap holder assembly in the closed configuration into the strap feeding assembly. The drive mechanism is also operable to move the strap holder assembly in the strap delivery position back to the strap receiving position.

The strap holder assembly, in some embodiments, includes a reciprocating upper clamping member and a lower clamp member that retain a portion of the strap when the strap holder assembly is in the closed configuration. The lower clamp member is moved away from the reciprocating upper clamping member when the strap holder assembly moves from the closed configuration towards the open configuration. The strap holder assembly can move from the closed configuration to the open configuration to allow the portion of the strap to be released from the strap holder assembly.

The strapping system can further include a strap dispenser for dispensing one or more straps to the strap holder assembly. During operation, a strap can be tensioned between the strap dispenser and the strap feeding assembly to automatically cause the strap to be released from the strap holder assembly. The released strap can be drawn taught between the strap dispenser and the strap feeding assembly, which delivers the strap to the accumulator at a desired line speed.

The strap feeding assembly includes one or more drive wheels, rollers, roller assemblies, and the like to guide the strap along a desired path. The strap feeding assembly, in some embodiments, includes a drive wheel and a nip roller that rotates to move the strap. The strap feeding assembly can include an entrance into which the end of the strap is delivered when the strap holder assembly is actuated. For example, the strap holder assembly can move along a predetermined path such that the strap end is inserted into a gap between the drive wheel and the nip roller at the entrance.

In some embodiments, a strap exchanger is adapted to sequentially deliver a plurality of straps to a component of the strapping system. The strap exchanger includes a strap feeding assembly, a strap holder assembly, and a drive mechanism. The strap holder assembly includes a clamp that is movable between a closed position and an open position. The drive mechanism has a first state of operation and a second state of operation. The drive mechanism is adapted to move the strap holder assembly from a strap receiving position to a strap delivery position when a strap is retained by the clamp in the closed position and the drive member is in the first state of operation. The drive mechanism is further adapted to move the strap holder assembly from the strap delivery position to the strap receiving position when the drive mechanism is in the second state of operation. The drive mechanism can be in the first state of operation when it rotates an output shaft in the first direction and the second state of operation when it rotates the output shaft in the opposite direction. The drive mechanism can include one or more motors that output the desired rotary motion used to move the strap holder assembly.

The strap holder assembly, in some embodiments, includes a reciprocating main body that cooperates with a strap support member of the clamp so as to fixedly retain the strap when the clamp is in the closed position. The strap support member can press the strap against the main body so as to limit, prevent, or inhibit relative movement between the strap and the strap holder assembly. In some embodiments, the strap support member is positioned underneath at least a portion of the strap when the clamp is in the closed position. The strap support member is moved away from the reciprocating main body as the clamp is moved from the closed position to the open position, thereby allowing the strap to be removed from the strap holder assembly.

The clamp, in some embodiments, is pivotably coupled to the main body of the strap holder assembly such that the clamp pivots about an axis of rotation that is generally parallel to a direction of travel of the strap holder assembly as the clamp holder assembly moves between the strap receiving position and the strap delivery position. In some embodiments, a drive member, such as a solenoid, moves the clamp from the closed position to the open position. In other embodiments, the clamp is moved from the closed position to the open position in response to tensioning of the strap. One or more biasing members of the strap holder assembly can allow the clamp to move to the open position as the strap is tensioned.

The strap feeding assembly can be configured to pull the strap from a rotatable spool about which the strap is wound. The wound strap can form a coil (e.g., a tightly wound coil) that can be unwound as the strap is pulled from the rotating spool. The strap feeding assembly can pull the strap from the spool with sufficient force to cause rotation of the spool. The resistance provided by the rotatable spool can be increased or decreased to increase or decrease the force required to move the clamp between the closed and open positions.

In some embodiments, a strap exchanger for a strapping machine includes a strap feeding assembly and a reciprocating strap holder assembly. The reciprocating strap holder assembly is capable of successively delivering a plurality of straps to the strap feeding assembly. The strap holder assembly is movable between a standby position for loading a respective one of the straps into the strap holder assembly and a delivery position for delivering the respective strap to the strap feeding assembly. The strap exchanger can be installed at various locations of the strapping machine. In some embodiments, the strap exchanger is positioned to deliver strap directly or indirectly to an accumulator of a strapping machine. The strap exchanger can also be positioned to deliver the strap to other components, if needed or desired.

In some embodiments, a method of delivering a first strap and a second strap to a strapping system for bundling objects is provided. The method includes delivering the first strap to a strap holder assembly of a strap exchanger. The strap exchanger is fixedly coupled to a frame of the strapping system. The first strap is delivered to a strap feeding assembly of the strap exchanger by moving the strap holder assembly carrying the first strap towards the strap feeding assembly. The strap holder assembly is moved away from the strap feeding assembly while the strap feeding assembly physically engages the first strap.

The first strap, in some embodiments, is released from the strap holder assembly while the strap feeding assembly physically retains or otherwise engages the first strap. A second strap is delivered to the strap holder assembly after releasing the first strap.

In some embodiments, the strap holder assembly is moved away from the strap feeding assembly while the first strap is pulled into and through the strap feeding assembly. A drive wheel and a nip roller of the strap feeding assembly can rotate together to move the first strap at a desired speed along a processing line.

In some embodiments, a method of delivering a first strap and a second strap to a strapping system is provided. The method comprises delivering a first strap to a strap feeding assembly of the strapping system. The strap feeding assembly is configured to move the first strap towards a track assembly of the strapping system. A second strap is delivered to a strap exchanger of the strapping system while the strap exchanger is in a strap receiving position. The first strap is moved through the strap feeding assembly to a track assembly adapted to bundle objects using the first strap. The first strap is removed from the strap feeding assembly. The second strap, carried by the strap holder assembly, is delivered to the empty strap feeding assembly by moving the strap exchanger from the strap receiving position to a strap delivery position.

In yet other embodiments, a method of delivering a plurality of straps to a strap feeding assembly of a strapping machine for bundling objects is provided. The plurality of straps are delivered to the strap feeding assembly by repeatedly reciprocating a strap holder assembly to load the strap holder assembly with respective ones of the plurality of straps and to deliver the respective one of the straps to the strap feeding assembly. The strap holder assembly is repeatedly reciprocated until the plurality of straps have been delivered to the strap feeding assembly. The strap feeding assembly can be loaded with a strap when it is empty.

BRIEF DESCRIPTION OF THE SEVERAL VIEWS OF THE DRAWINGS

In the drawings, identical reference numbers identify similar elements or acts.

DETAILED DESCRIPTION

The present disclosure is directed to, among other things, strapping systems, components of strapping systems (e.g., strapping units, strap dispensers, strap exchangers, accumulators, and the like) and methods for strapping product. Specific details of certain embodiments are set forth in the following description, and in FIGS. 1-16, to provide a thorough understanding of such embodiments. In view of the present disclosure, a person of ordinary skill in the art will understand that the present invention may have additional embodiments and features, and that the invention may be practiced without several of the details described in the following description.

Throughout the following description and in the accompanying figures, straps are shown and referred to as particular types of straps, namely, flat, two-sided, strips of material solely for the purposes of simplifying the description of the various embodiments. It should be understood, however, that the methods and embodiments disclosed herein may be equally applicable to various types of other straps, and not just to the illustrated flat, tape-shaped straps. Thus, as used herein, the terms "strap" and "strap material" include, without limitation, all types of straps used to bundle objects. These straps can be comprised of one or more synthetic materials, natural materials, metallic materials, or some other more rigid strap material. One type of strap that may be used with all or some of the embodiments described herein is a paper cord type strap comprised of individual round cords laterally bound together to form a continuous strap. This strap may be rigid, semi-flexible, or flexible depending on the application. If the strap is used to bundle product in the form of a stack of objects, the strap can be sufficiently compliant to closely surround the stack.

Figure 1:
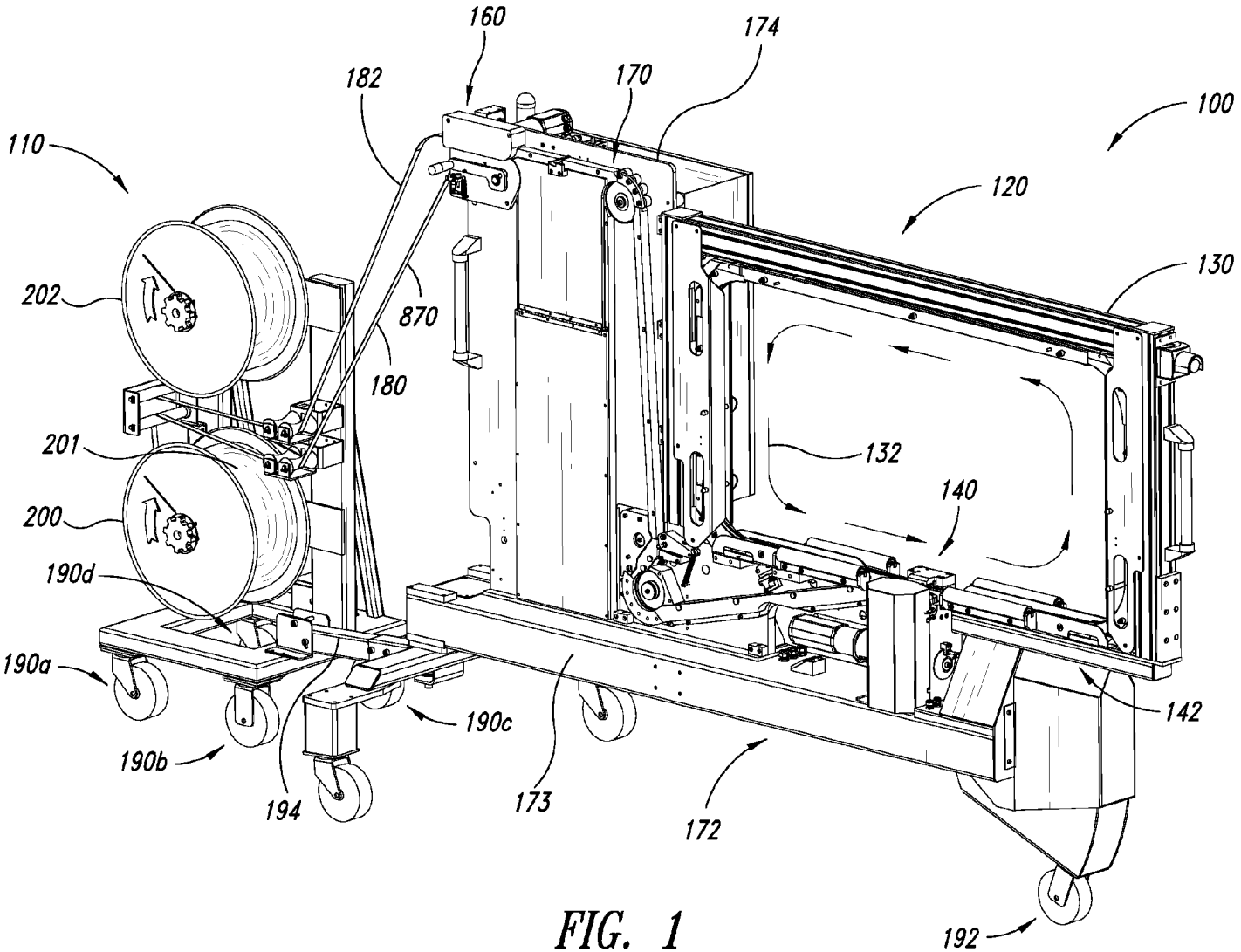
FIG. 1 is a pictorial view of a strapping system including an automatic strap exchanger, in accordance with one embodiment.

FIG. 1 shows a strapping system 100 that includes a strap dispenser 110 for dispensing a pair of straps 180, 182 and a strapping unit 120 for bundling objects using the straps 180, 182. Bundling includes, without limitation, wrapping together, tying together, bundling together, combinations thereof, or the like. During a bundling operation, the strap 180 is fed about a track assembly 130 of the strapping unit 120 in a strap feed direction 132 that is in the counterclockwise direction. The strap 180 is applied to product (not shown) positioned at a strapping region 140 of the strapping unit 120. The illustrated strapping region 140 is located along a bottom section 142 of the track assembly 130. The track assembly 130 can apply a strap about a stack of objects at the strapping region 140 to keep the objects tightly bound together.

The strapping unit 120 further includes an automatic strap exchanger 160 and an accumulator 170. The strap exchanger 160 is capable of receiving and delivering straps to the accumulator 170. In the illustrated embodiment, the lower strap 180 is ready to bundle objects and extends through the strap exchanger 160, the accumulator 170, and the track assembly 130. When a strap coil 201 is depleted, the strap exchanger 160 can rapidly replace the lower strap 180 with the upper strap 182 to route the upper strap 182 through the accumulator 170 and the track assembly 130. The upper strap 182 is then used to bundle objects. The upper strap 182 can be loaded into the strap exchanger 160 before, during, or after the lower strap 180 is routed through the strapping unit 120. In some embodiments, the strap exchanger 160 is capable of successively delivering straps to the accumulator 170 to route those straps through the strapping unit 120.

The strapping unit 120 includes a frame 172 that carries various components. The frame 172 includes a lower frame 173 carrying the track assembly 130 and an upper frame 174 carrying the strap holder assembly 160 and the accumulator 170. The lower frame 173 is a generally horizontal frame that is approximately perpendicular to the upper frame 174, illustrated as a rigid plate. The frame 172 can have other configurations based on the arrangement of the components of the strapping unit 120. A user can conveniently move the strap dispenser 110 relative to the strapping unit 120 to adjust the orientation of the sections of the straps 180, 182 extending between the dispenser 110 and the strapping unit 120.

The illustrated strap dispenser 110 includes wheels 190*a-d* capable of rolling across a support surface. A spacer 194 can be used to position the strap dispenser 110 relative to the strapping unit 120. The length of the spacer 194 can be increased or decreased to increase or decrease, respectively, the lengths of the sections of the straps 180, 182 extending between the dispenser 110 and the strapping unit 120.

Figure 2:
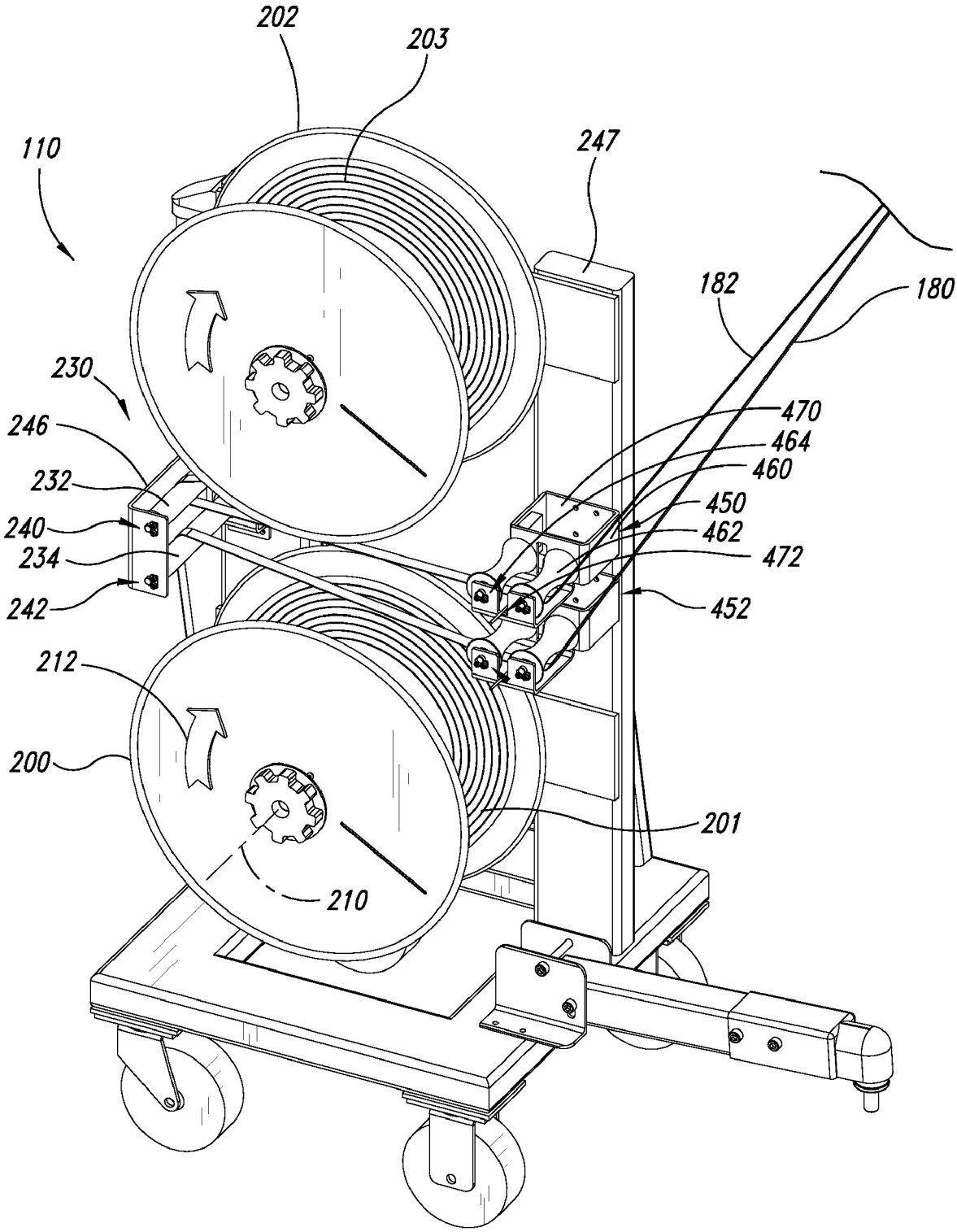
FIG. 2 is a pictorial view of a strap dispenser for delivering a pair of straps to a strapping unit, in accordance with one embodiment.

FIG. 2 shows the strap dispenser 110 that includes an upper spool 202 and a lower spool 200. The lower strap 180 is wound about the lower spool 200 to form the lower coil 201, and the upper strap 182 is wound about the upper spool 202 to form an upper coil 203. To dispense the lower coil 201, the lower spool 200 rotates about an axis of rotation 210 in a clockwise direction, indicated by an arrow 212, while the upper spool 202 remains stationary during this process. The strap dispenser 110 can include any number of spools for dispensing straps. For example, the strap dispenser 110 can be modified to include three independently rotatable spools, each carrying a strap coil.

To deliver strap to the strapping unit 120, an operator can load the straps 180, 182 onto the upper and lower spools 200, 202, respectively. Free ends of the straps 180, 182 can be threaded through a turn roller assembly 230. The illustrated turn roller assembly 230 includes turn rollers 232, 234, support shafts 240, 242, and a support bracket 246 coupled to a support frame 247. The straps 180, 182 extend about the turn rollers 234, 232, respectively.

The free ends of the straps may then be threaded through corresponding strap exhausted switch assemblies 450, 452. The strap exhausted switch assemblies 450, 452 can be generally similar to each other, and accordingly, the description of one applies equally to the other, unless clearly indicated otherwise. The switch assembly 450 generally includes a support bracket 460, a pair of rollers 462, a pair of shafts 464 that permit rotation of the rollers 462, a limit switch 470, and an actuation rod 472. The actuation rod 472 can physically contact the strap 182. The exhausted switch assembly 450 can indicate to a user when the strap 182 should or can be replaced. For example, when a tail end of the strap 182 passes by the actuation rod 472, the switch assembly 450 can indicate that the upper coil 203 is depleted. In some embodiments, the switch assembly 250 sends one or more signals to a control system of the strapping unit 120 indicating depletion of the upper coil 203. The control system in turn notifies an operator to refill the upper spool 202 with another strap, to replace the empty spool 202 with a new filled spool.

Other types of strap dispensers can also be used with the strapping unit 120, if needed or desired. Strap dispensers can include horizontally oriented spools carrying strap coils, folded straps, and the like. The type and configuration of the strap dispensers can be selected based on the orientation and position of the strap exchanger 160, characteristics of straps (e.g., flexibility), or the like.

Figure 3:
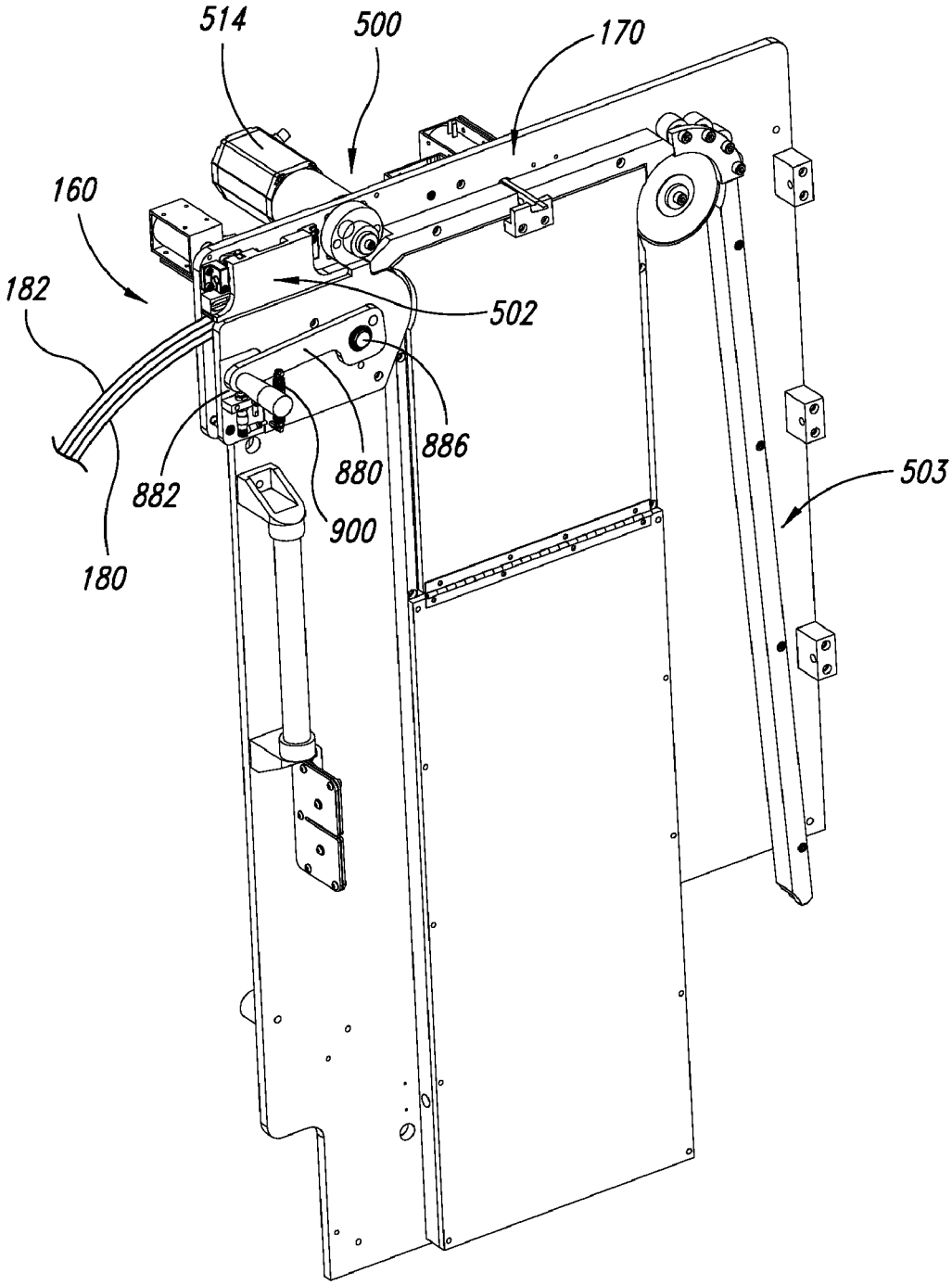
FIG. 3 is a pictorial view of an upstream portion a strapping unit including an automatic strap exchanger and an accumulator, in accordance with one embodiment.
Figure 4:
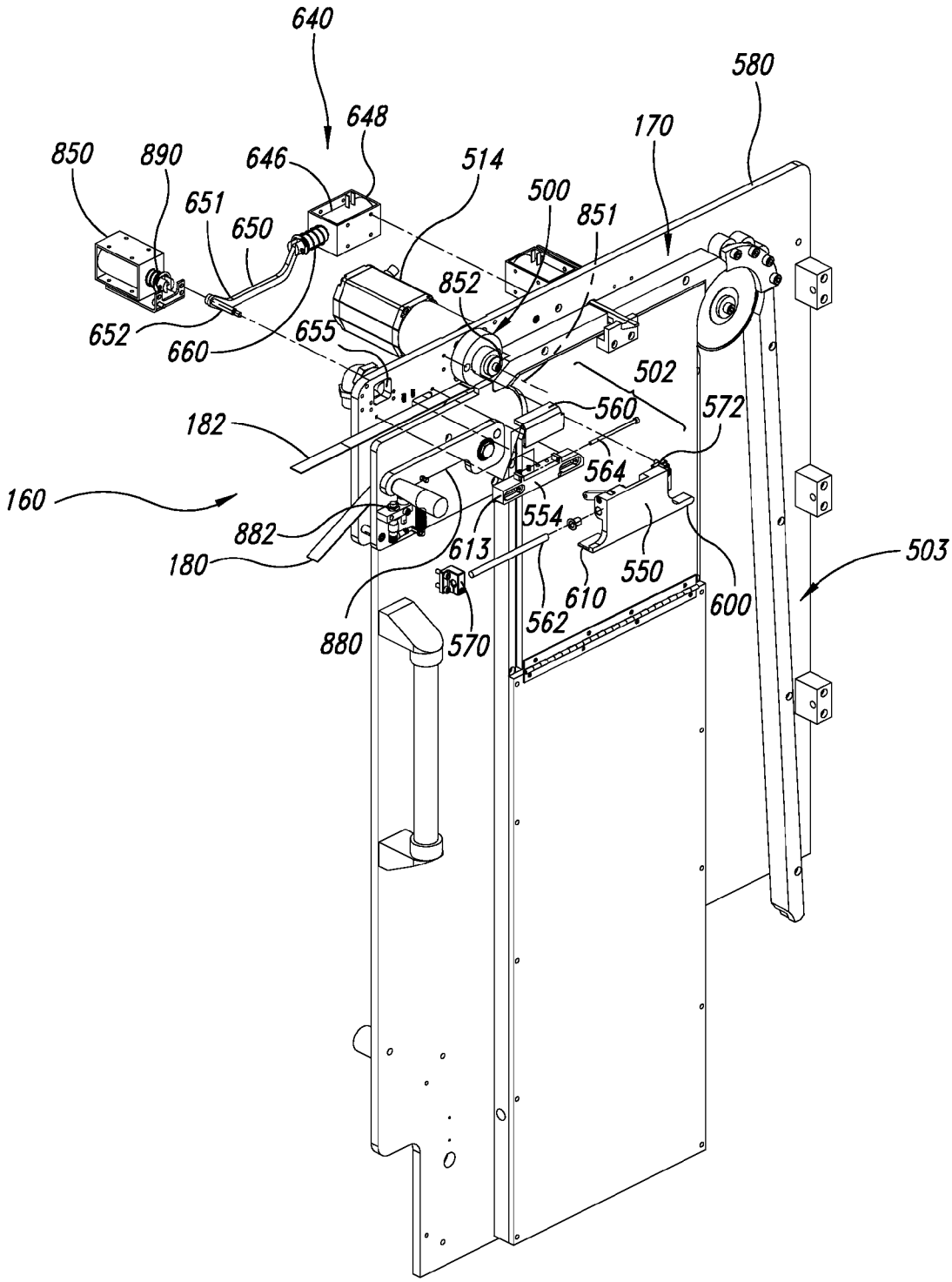
FIG. 4 is a partial exploded view of upstream portion of FIG. 3.

FIGS. 3 and 4 show the strap exchanger 160 that includes a strap feeding assembly 500 for delivering strap to the adjacent accumulator 170 and a strap holder assembly 502 for successively delivering straps to the strap feeding assembly 500. Generally, the strap holder assembly 502 is movable between a standby position for receiving and retaining a strap and a delivery position for delivering that strap to the strap feeding assembly 500. FIG. 4 shows the strap 182 held by the strap holder assembly 502 in the standby position, and the strap 180 passing through the strap feeding assembly 500 and into the accumulator 170. During strapping operations, the strap feeding assembly 500 can discontinuously (e.g., periodically) or continuously advance the strap 180 into the accumulator 170.

Figure 5:
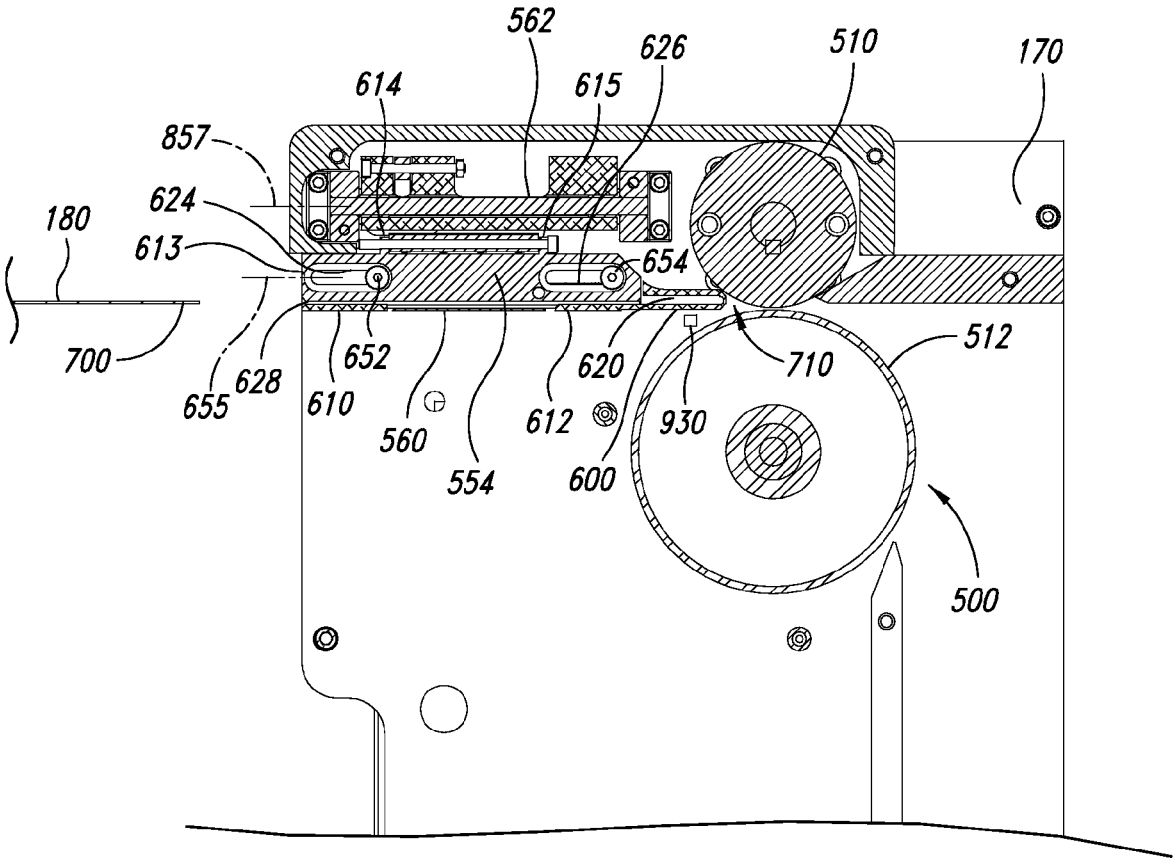
FIG. 5 is a cross-sectional view of an empty strap exchanger ready to receive a strap, in accordance with one embodiment.

Referring to FIGS. 3-5, the strap feeding assembly 500 includes a drive wheel 510, a roller 512, and a drive device 514 that rotates the drive wheel 510 causing the strap 180 to move towards the accumulator 170. The roller 512 can be, without limitation, an idle roller, a nip roller, or the like, as well as other components (e.g., stationary components, movable components, and the like) suitable for guiding straps. Additional rollers or drive wheels can be incorporated into the illustrated strap feeding assembly 500 to route the lower strap 180 along a desired processing path. The illustrated drive device 514 may be configured to convert electrical energy to mechanical force or motion and can be in the form of a DC motor (e.g., a brushless DC motor, brushed DC motor, and the like), AC motor, or other drive device suitable for outputting the desired force or motion. In some embodiments, the drive device 514 is in the form of a stepper motor.

Referring to FIG. 4, the strap holder assembly 502 includes a strap guide 550, a main body 554, and a clamp 560. A pin 562 pivotally couples the guide 550 to the main body 554. A pin 564 pivotally couples the clamp 560 to the main body 554. The guide 550 and the vertical frame 580 help constrain the straps 180, 182. The guide 550 is capable of moving away from the main body 554 to expose a retained strap. Mounting brackets 570, 572 couple the pin 562 to the frame 580 to which both the strap holder assembly 502 and the accumulator 170 are mounted.

Referring to FIGS. 4 and 5, the strap guide 550 includes a strap guard 600 and a pair of spaced apart strap supports 610, 612. The strap guard 600 includes a chamber 620 for receiving a strap end such that the strap end is prevented from entering the strap feeding assembly 500. In the illustrated embodiment, the strap guard 600 is a generally U-shaped member (viewed from the side) and the chamber 620 is slightly larger than the strap to be delivered therein. The shape and configuration of the strap guard 600 can be selected based on the shape and configuration of the strap end.

Figure 6:
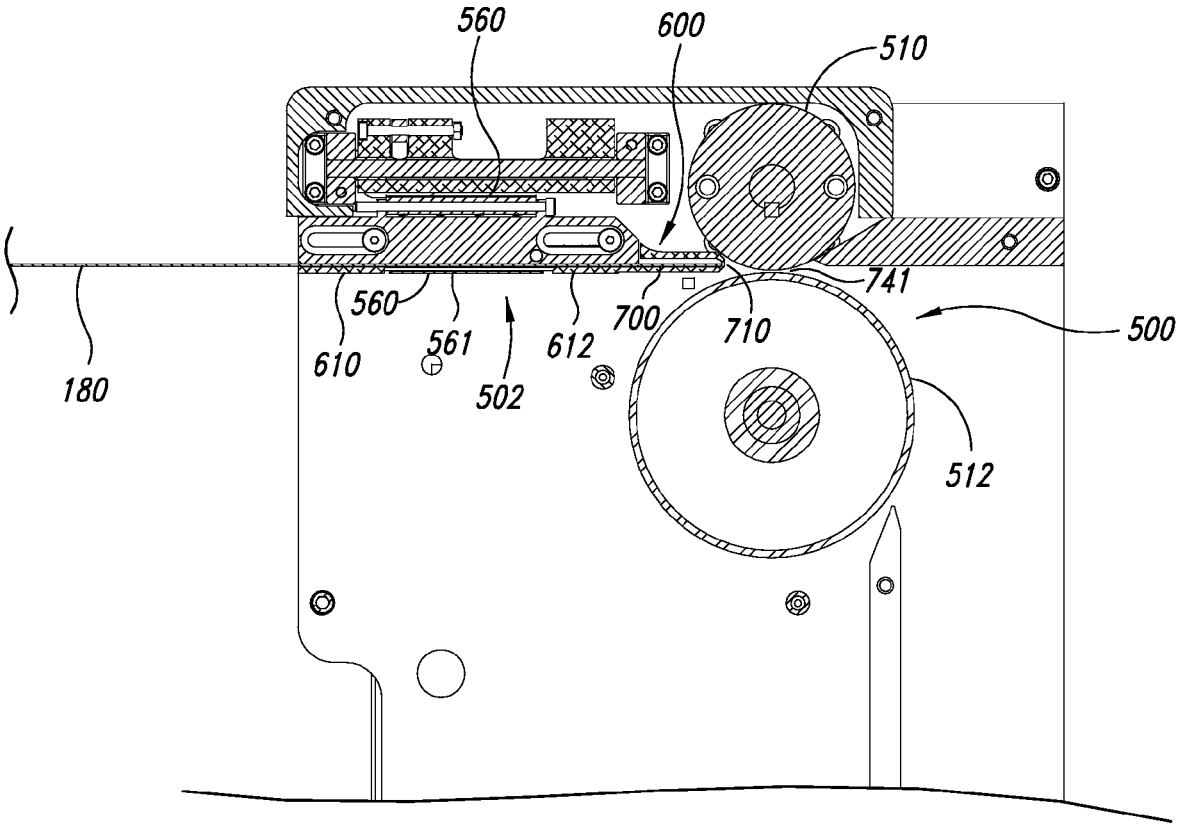
FIG. 6 is a cross-sectional view of a loaded strap exchanger ready to deliver a strap to a strap feeding assembly, in accordance with one embodiment.
Figure 7:
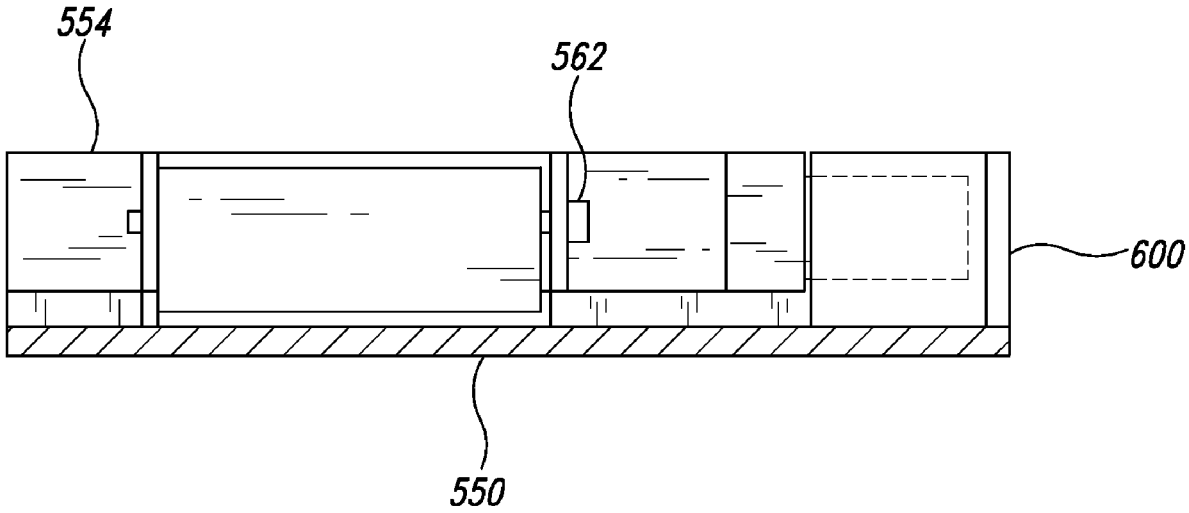
FIG. 7 is a plan view of a strap guard surrounding an end of a strap carried by a strap holder assembly, in accordance with one embodiment.
Figure 8:
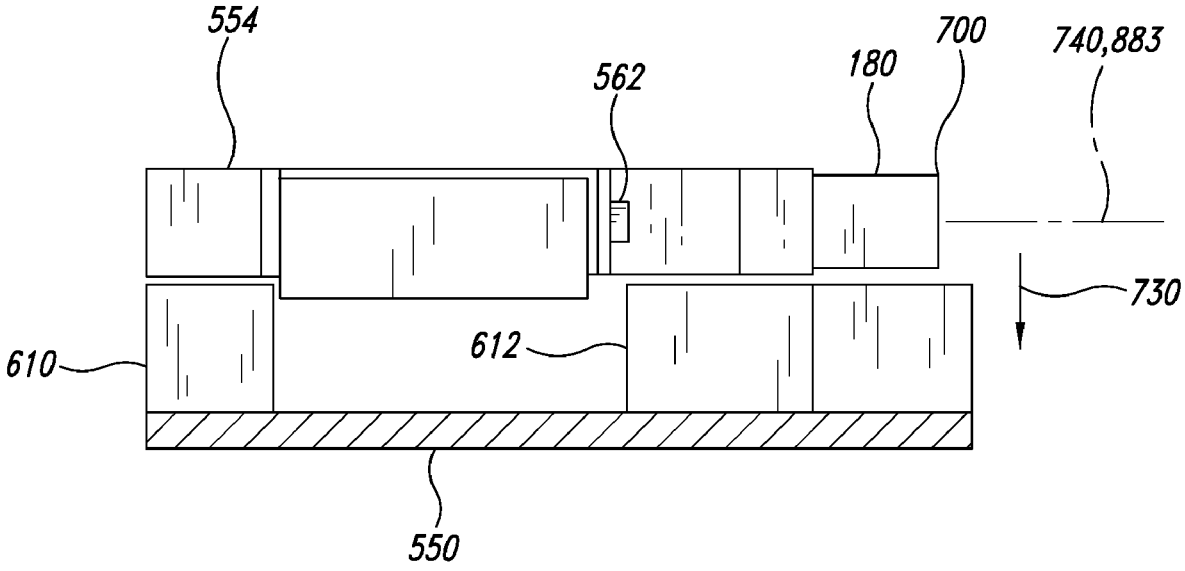
FIG. 8 is a plan view of the strap guard of FIG. 7 moved away from the strap.

The strap supports 610, 612 are cantilevered members that extend underneath the main body 554 to define a receiving passageway 628 for receiving a strap. When the strap guide 550 is in a closed position, the strap can rest upon the strap supports 610, 612, as shown in FIG. 6. When the strap guide 550 is moved to an open position, the strap supports 610, 612 will disengage the strap 180, as discussed in connection with FIGS. 7 and 8.

Referring to FIG. 5, the main body 554 includes an upper clamp member 613 and a pair of spaced apart mounting features 614, 615 extending upwardly from an upper clamp member 613. The pin 564 extends between the mounting features 614, 615. The upper clamp member 613 includes elongate slots 624, 626 that receive pins 652 654, respectively, such that the upper clamp member 613 travels along a path 655. The path 655 may be a generally curvilinear path, arcuate path, rectilinear path, straight path, combinations thereof, or the like. The illustrated strap holder assembly 502 can move alternately backward and forward to translate a strap along a generally straight path that is parallel to the path 655.

Referring again to FIG. 4, the strap exchanger 160 further includes a drive mechanism 640 operable to move the strap holder assembly 502 from a strap receiving position (shown in FIG. 5) to a strap delivery position (shown in FIG. 9) so as to deliver the strap 180 to the strap feeding assembly 500. The drive mechanism 640 can also move the strap holder assembly 502 from the strap delivery position back to the strap receiving position. In this manner, the drive mechanism 640 can reciprocate the strap holder assembly 502.

The illustrated drive mechanism 640 includes a driver 646 coupled to an actuation rod 650. The driver 646 can include, without limitation, one or more solenoids, actuators (e.g., pneumatic actuators, hydraulic actuators, or the like), combinations thereof, or the like. In some embodiments, the driver 646 is a selectively energizable solenoid having a first state for moving the strap holder assembly 502 from the strap receiving position to the strap delivery position and a second state for moving the strap holder assembly 502 from the strap delivery position back to the strap receiving position. The illustrated embodiment includes a solenoid return spring 660 capable of biasing the main body 540 to the initial strap receiving position.

The actuation rod 650 includes an elongate body 651 and a rotatable pin 652 coupled to the elongate body 651. The pin 652 extends through an aperture 655 in the frame 580 and extends through the elongated slot 624. The aperture 655 is sufficiently large to allow desired translation of the pin 652.

FIGS. 5-15 illustrate one method of sequentially loading the straps 180, 182 into the strapping unit 120. Generally, a user can manually load the strap holder assembly 502 with the lower strap 180. The strap holder assembly 502 automatically delivers the lower strap 180 to the strap feeding assembly 502. The user can then load the upper strap 182 into the empty strap holder assembly 502. Once the strap feeding assembly 500 is empty, the strap holder assembly 502 can deliver the upper strap 182 to the empty strap feeding assembly 500. The strap holder assembly 502 can then be loaded with an additional strap such that the strap feeding assembly 500 is repeatedly loaded with additional straps when it is empty.

FIG. 5 shows the readily accessible strap passageway 628. A user can manually insert an end 700 of the strap 180 into the strap passageway 628, while the strap holder assembly 502 remains substantially stationary. The end 700 can be moved through the passageway 628 until the end 700 is at least partially surrounded by the strap guard 600. In some embodiments, the end 700 is advanced through the passageway 628 until the strap end 700 contacts the tip of the strap guard 600.

The strap guard 600 of FIG. 6 prevents the strap end 700 from inadvertently entering an entrance 710 of the strap feeding assembly 500. The strap 180 is supported by the strap supports 610, 612 and the clamp 560. Because the strap end 700 is proximate to the entrance 710, the strap end 700 can be rapidly delivered to the entrance 710, if needed or desired. In some embodiments, the distance between the entrance 710 and the strap end 700 is less than or equal to about 3 inches, 2 inches, or 1 inch, or ranges encompassing such distances. Other distances are also possible, if needed or desired.

To define an unobstructed path between the strap end 700 and the entrance 710, the guide 550 is moved away from the strap 180. The guide 550 may be moved between a closed position (FIG. 7) and an open position (FIG. 8) by rotating about the pin 562, as indicated by the arrow 730. After the guide 550 is moved laterally away from a longitudinal axis 740 of the strap 180, the strap end 700 is uncovered and projects outwardly from the main body 554 towards the entrance 710.

After the guide 550 is in the open position, the strap 180 is moved towards the entrance 710 of the strap feeding assembly 500. As the strap holder assembly 502 moves to the strap delivery position, the strap end 700 moves through a gap 741 (FIG. 6) between the drive wheel 510 and roller 512. The length of the section of the strap 180 extending from the strap holder assembly 502 can be increased or decreased based on the dimensions of the components of the feeding assembly 500 to ensure that the strap holder assembly 502 avoids striking and damaging the drive wheel 510 or the roller 512, or both.

The clamp 560 is biased to minimize, limit, or substantially prevent relative movement between the strap 180 and the strap holder assembly 502. In some embodiments, the clamp 560 is capable of fixedly retaining the strap 180. A lower clamp member 561 of the clamp 560 may be biased against the upper clamp member 613 with a sufficient force to substantially prevent unwanted movement of the strap 180. In other embodiments, the lower clamp member 561 is spaced apart from the upper clamp member 613 such that the strap 180 rests upon the lower clamp member 561 but does not contact the upper clamp member 613.

Figure 9:
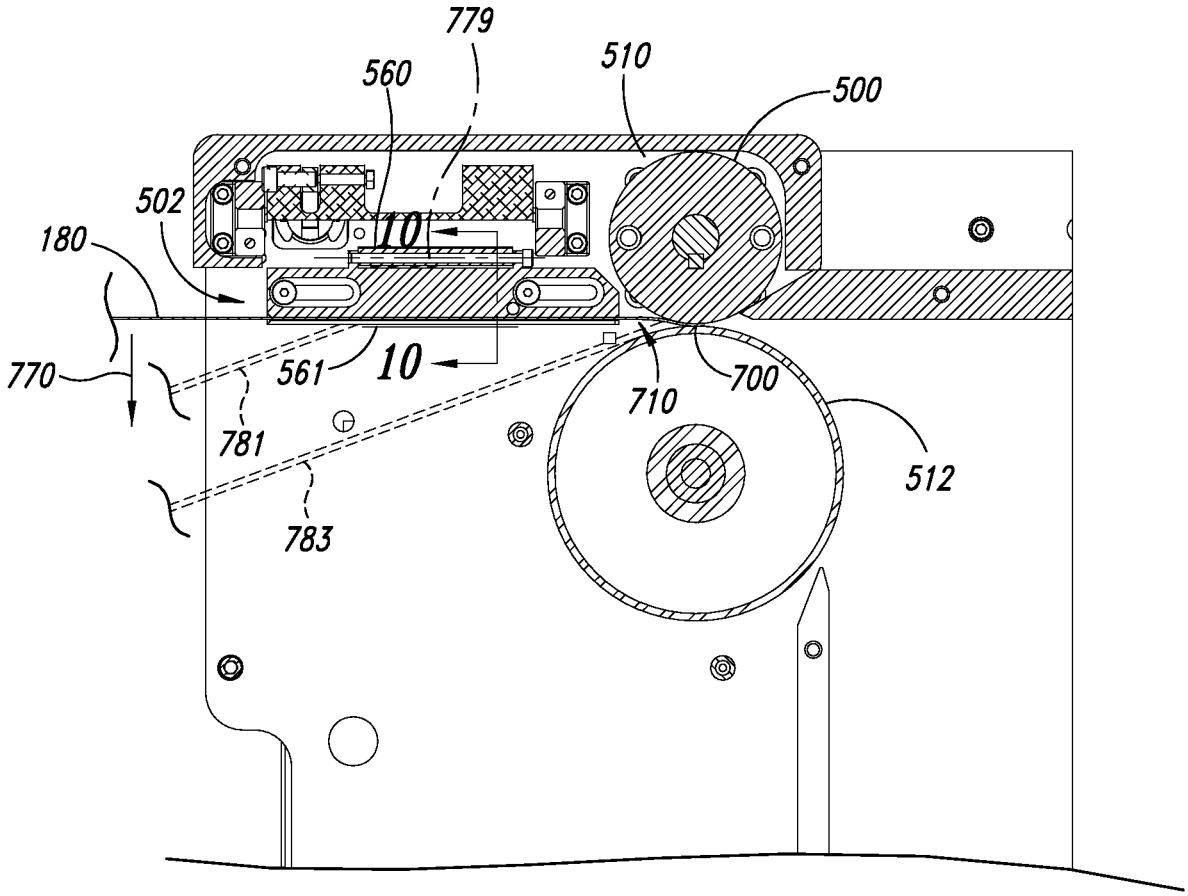
FIG. 9 is a cross-sectional view of a strap exchanger delivering a strap to a strap feeding assembly, in accordance with one embodiment.

FIG. 9 shows the strap 180 retained by the clamp 560 and the main body 554, and the strap end 700 sandwiched between the drive wheel 510 and the roller 512. To release the strap 180, the strap holder assembly 502 moves from the illustrated closed configuration to an open configuration.

Figure 10:
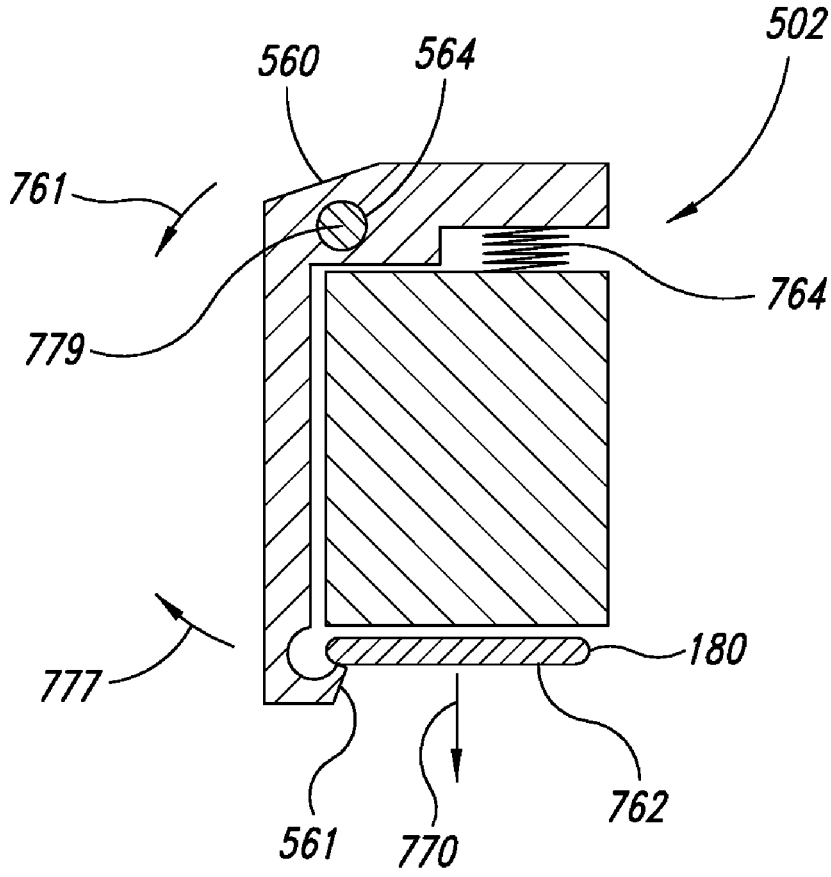
FIG. 10 is a cross-sectional view of a strap holder assembly taken along line 10-10 of FIG. 9.

FIG. 10 shows the strap holder assembly 502 in the closed configuration. The lower clamp member 561 contacts a lower surface 762 of the strap 180. One or more biasing members 764 bias the clamp 560 towards the illustrated closed position (i.e., in the counterclockwise direction about the pin 564, as indicated by an arrow 761) such that the lower clamp member 561 is positioned underneath at least a portion of the strap 180. The biasing member 764 can be in the form of one or more springs (e.g., helical springs, coil springs, and the like), compressible members (e.g., rubber disks), solenoids, and the like. The type, number, and size of the biasing members 764 can be selected based on the desired range of motion of the clamp 560.

Figure 11:
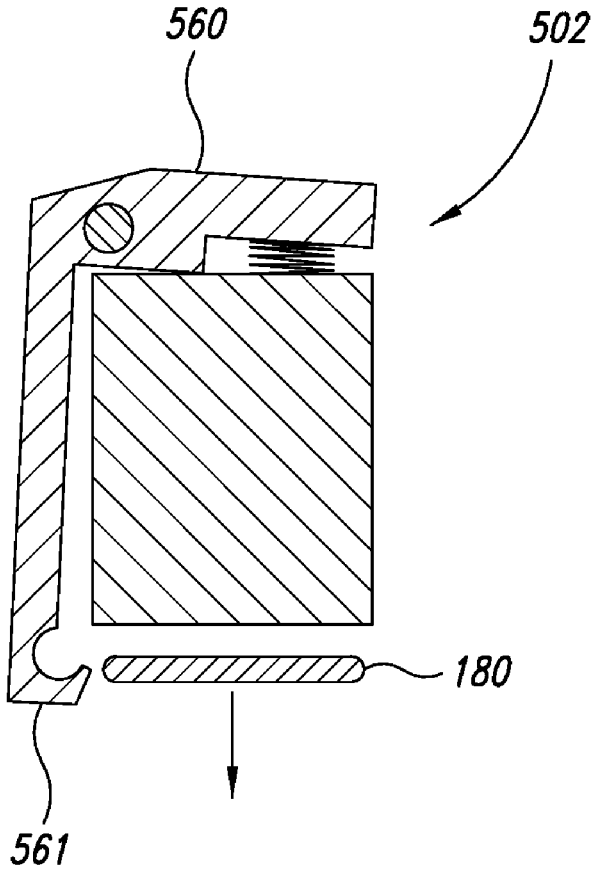
FIG. 11 is a cross-sectional view of a strap holder assembly taken along line 10-10 of FIG. 9, the strap holder assembly is releasing the strap.

When a sufficient force (represented by the arrow 770 of FIGS. 9 and 10) is applied to the strap 180, the clamp 560 rotates about the pin 564, as indicated by the arrow 777, such that the strap 180 moves downwardly past the lower clamp member 561. The pin 564 defines an axis of rotation 779 that is generally parallel to the direction of travel of the strap holder assembly 502. In some embodiments, an angle defined by the axis of rotation 779 and the direction of travel is equal to or less than 5 degrees, 2.5 degrees, or 1 degree. Other angles are also possible. By way of example, when the strap 180 is pulled from the spool 200, the strap 180 can be pulled downwardly using a force sufficient to overcome the bias applied to the clamp 560. The forces applied by the biasing member 764 can be selected based on the desired force needed to open the clamp 560, as shown in FIG. 11.

The lower spool 200 of FIG. 1 is positioned below the strap exchanger 160 such that tensioning the strap 180 using the dispenser 110 causes the clamp 560 to move from the closed position to the open position. In this manner, the lower clamp member moves away from the reciprocating upper clamp member 613 to move the strap holder assembly 502 to the open configuration. The feeding assembly 500 pulls the strap 180 into the accumulator 170 to tension the strap 180 to a tensioned position 781 (shown in broken line in FIG. 9). The clamp 560 opens and allows the strap 180 to fall to the released position 783 (shown in broken line in FIG. 9). Bundling operations can then be performed using the strap 180.

Figure 12:
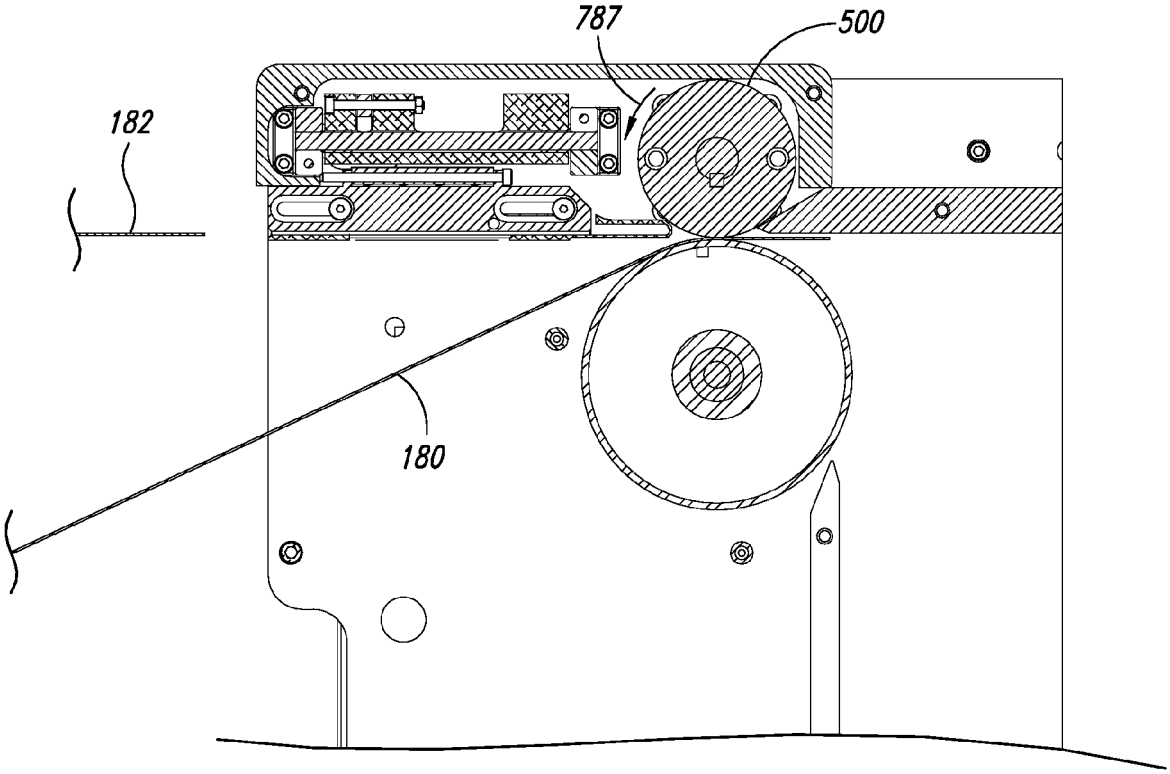
FIG. 12 is a cross-sectional view of a strap exchanger with an empty strap holder assembly and a strap passing through a strap feeding assembly, in accordance with one embodiment.

After the strap 180 is released from the strap holder assembly 502, the clamp 560 can return to its closed configuration. Once the strap holder assembly 502 is returned to the closed configuration, it can be loaded with another strap, as shown in FIG. 12. The strap 180 of FIG. 12 is delivered to the accumulator 170 by rotating the drive wheel 510 in the counterclockwise direction (indicated by arrow 787) while an operator loads the empty strap holder assembly 502 with the strap 182.

Figure 13:
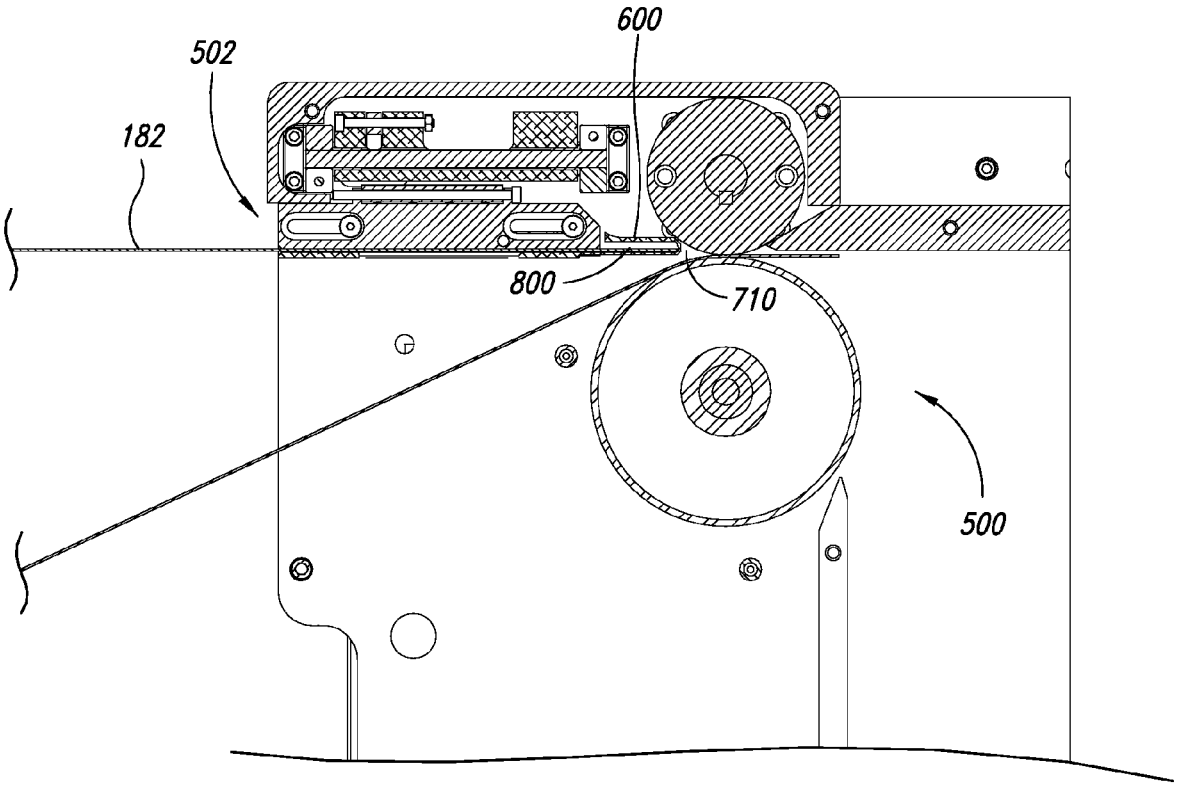
FIG. 13 is a cross-sectional view of a strap exchanger with a loaded strap holder assembly in a standby position, in accordance with one embodiment.

FIG. 13 shows the strap holder assembly 502 after loading the strap 182. The strap guard 600 keeps an end 800 of the upper strap 182 adjacent to, but spaced from, the entrance 710 of the feeding assembly 500. The strap 180 can be pulled through the strapping unit 120, while the strap holder assembly 502 remains in the standby position ready to deliver the strap 182 to the feeding assembly 500 once the strap 180 is consumed.

Figure 14:
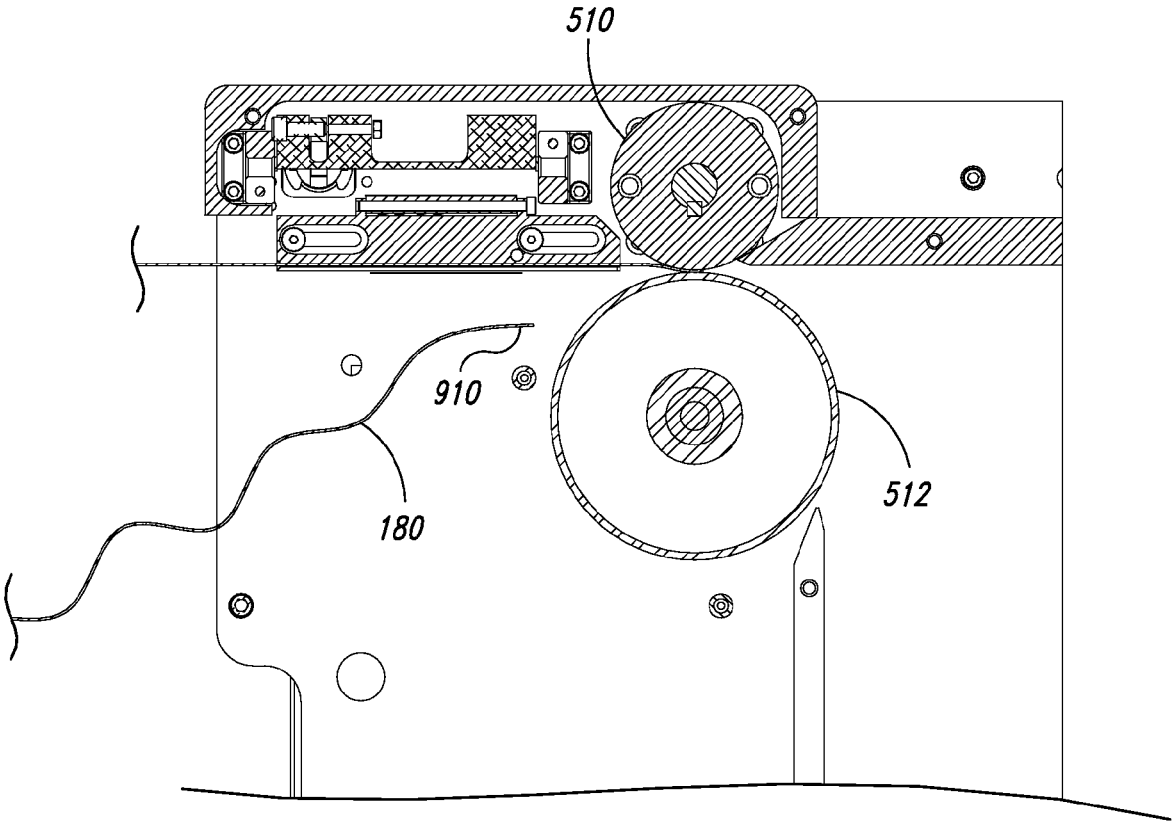
FIG. 14 is a cross-sectional view of a strap exchanger delivering another strap to the strap feeding assembly of FIG. 13 after the strap is discharged from the strap feeding assembly, in accordance with one embodiment.

To replace the strap 180, the strap 180 is ejected from the feeding assembly 500 and removed from the strapping unit 120. FIG. 14 shows the strap end 910 of the strap 180 discharged from the feeding assembly 500. To load the strap 182 into the strapping unit 120, the strap holder assembly 502 is moved from the strap receiving position (FIG. 13) to the strap delivery position (FIG. 14).

Figure 15:
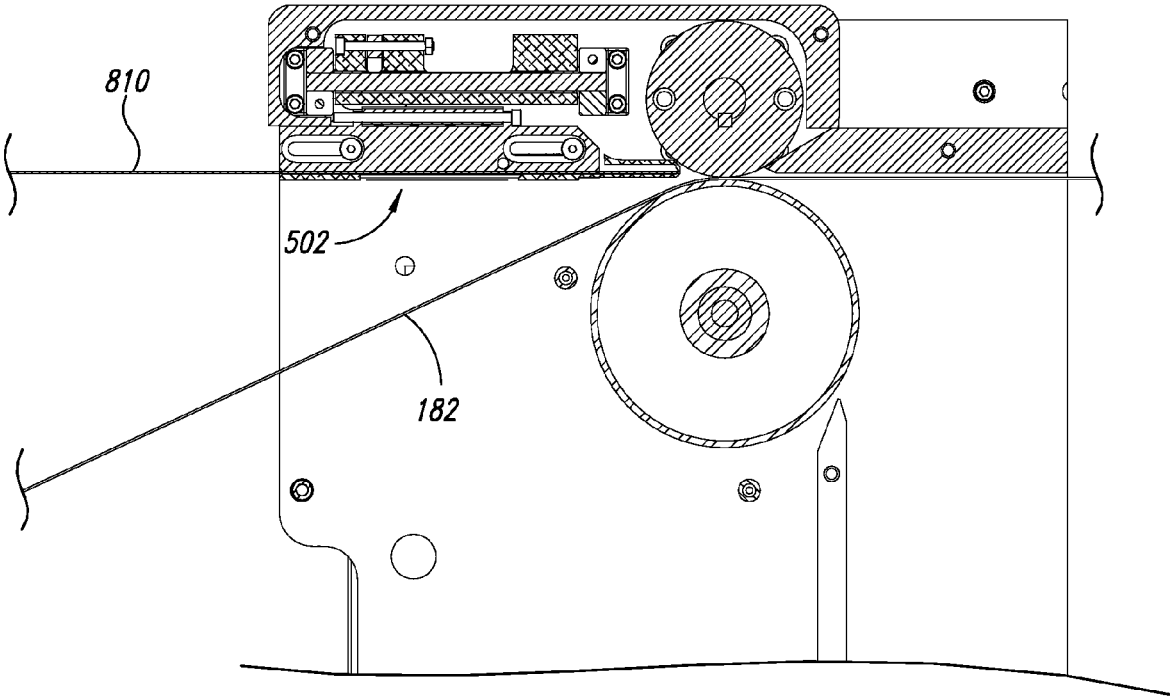
FIG. 15 shows a strap holder assembly loaded with a strap and another strap passing through a strap feeding assembly to an accumulator, in accordance with one embodiment.
Figure 16:
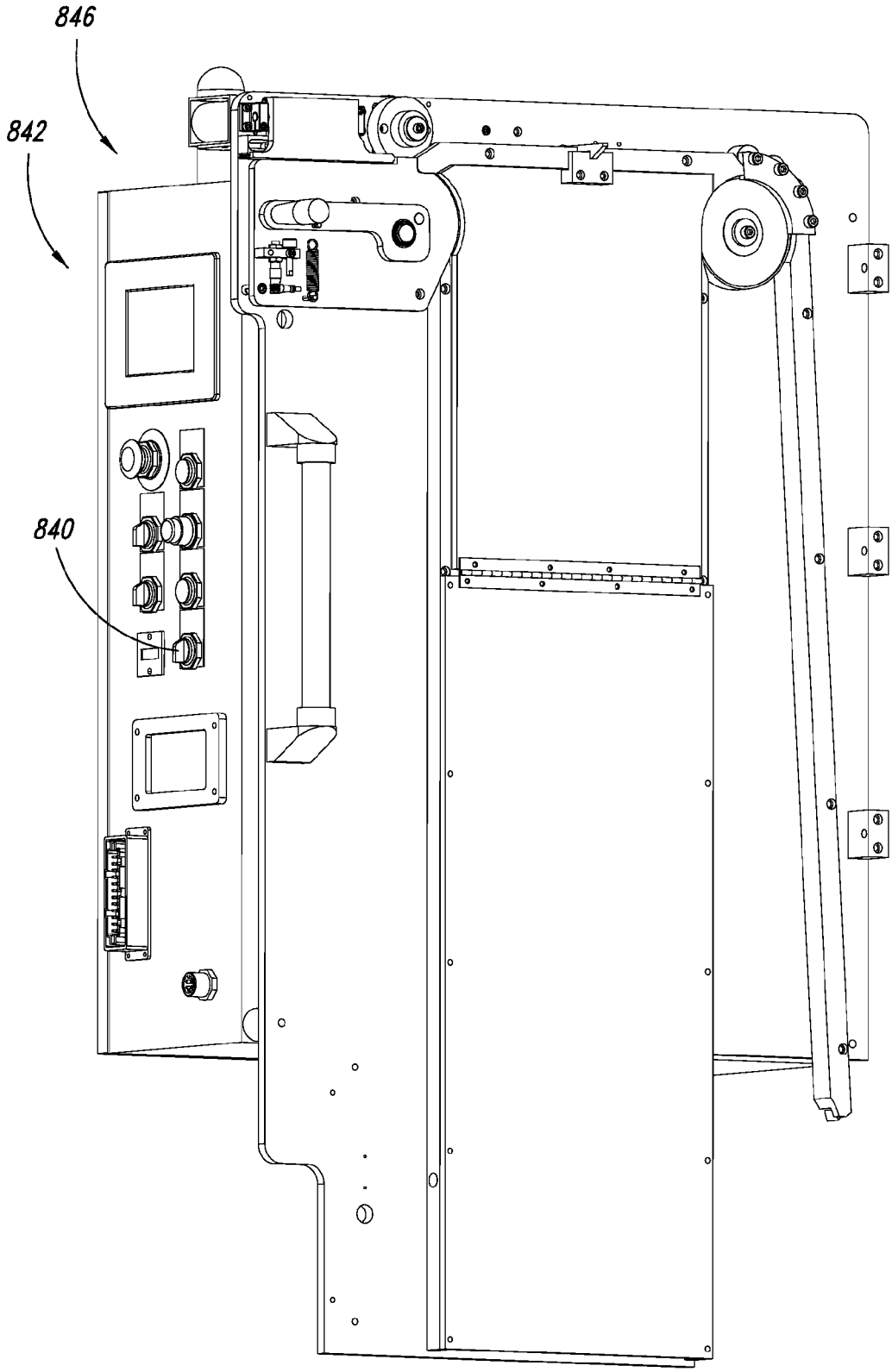
FIG. 16 is a pictorial view of a control system of a strapping unit, in accordance with one embodiment.

FIG. 15 shows the loaded strap 182 passing through the strap feeding assembly 500. An operator can load yet another strap 810 to perform another strap exchange process when the strap 182 is insufficient for performing bundling operations. Thus, a user can periodically load the strap holder assembly 502 to perform any desired number of automatic feed sequences.

To start an automatic feed sequence, the user operates a feed/eject selector switch 840 (FIG. 16) on an accessible control panel 842. The illustrated feed/eject selector switch 840 is moved to a "feed" position. The controller system 846 sends a signal to the motor 514 (FIG. 3), which causes rotation of the drive wheel 510 about an axis of rotation 851 (FIG. 4) defined by a shaft 852. A strap guard actuator 850 (FIG. 4) is energized to rotate the strap guard 550 about an axis of rotation 857 (FIG. 5) defined by the pin 562. The strap guard 550 rotates away from the strap 180 to provide an unobstructed path between the strap 180 and the entrance 710 of the feeding assembly 500.

The solenoid 646 of the drive mechanism 640 is energized to slide the strap holder assembly 502 (FIG. 4) in a direction generally aligned with the longitudinal axis 740 of the strap 180. In some embodiments, the strap holder assembly 502 is moved along a path 883 (FIG. 8) that is approximately parallel or collinear with the longitudinal axis 740. The end 700 of the strap 180 is inserted between the rotating drive wheel 510 and the roller 512. After the strap 180 is sandwiched between the drive wheel 510 and the roller 512, the feeding assembly 500 pulls the strap 180 into the strapping unit 120 and moves the strap 180 into the adjacent accumulator 170. U.S. patent application Ser. No. 12/072,107, incorporated by reference in its entirety, discloses accumulators suitable for use with the strapping system 100 and methods of using accumulators. The strap exchanger 160 can be used with these types of accumulators, as well as other components of strapping units disclosed in U.S. patent application Ser. No. 12/072,107.

The strap dispenser 110 of FIG. 1 is spaced apart from the strap feeding assembly 500 such that a tensioned strap section 870 between the strap dispenser 110 and the strap feeding assembly 500 causes the strap holder assembly 502 to move from the closed configuration to the open configuration. For example, the incoming strap path geometry is such that the strap 180 is pulled in a downward direction and released from the spring-loaded clamp 560. The tensile force applied to the strap section 870 can overcome the biasing force provided by the biasing member 764 to open the clamp 560.

As the strap 180 enters between the drive roller 510 and the roller 512, a roller handle 880 (FIG. 3) moves away from and causes activation of a sensor 882 (e.g., a proximity sensor). In some embodiments, the handle 880 operates on an eccentrically rotating shaft 886. The deactivated sensor 882 sends one or more signals to the control system 846. Based at least in part on those signals, the control system 846 causes the driver 646 to de-energize, thereby allowing the return spring 660 to return the empty strap holder assembly 502 to the strap receiving position. The feeding assembly 500 can advance the strap 180 towards the accumulator 170 before, during, and/or after the strap holder assembly 502 returns to the strap delivery position. For example, the strap 180 can be routed through the strapping unit 120 and delivered to the track assembly 130 while the strap holder assembly 502 is returned to the strap receiving position.

To deliver the strap 180 to the track assembly 130, the feeding assembly 500 pulls the strap 180 from the spool 200 and delivers the strap 180 to the accumulator 170. As the accumulator 170 begins to fill with the strap 180, the accumulator full sensor signals the control system 846 which de-energizes the strap guard actuator 850 (FIG. 4) causing a solenoid return spring 660 to return the strap guard 550 to its home position, thus completing the initial feed sequence. The strap 180 passes through the accumulator 170 and is ultimately delivered to the track assembly 130 for a bundling process.

With the strap exchanger 160 in the strap delivery position, the operator inserts the free end 800 of the upper strap 182 into the exchanger 160. The loaded exchanger 160 can remain generally stationary until the lower spool 200 has been depleted. The de-actuated strap exhausted switch 450 can send a signal to the control system 846 indicating depletion of the lower spool 200.

The strap 180 can be removed from the feeding assembly 500 to load the strap 182 into the feeding assembly 500. The illustrated drive wheel 510 rotates in a clockwise direction to withdraw the remaining strap 180 from the accumulator 170 and to push the strap 180 out of the strapping unit 120. The biasing member 900 (FIG. 3) pulls the handle 880 in a downward direction when the direction of travel of the strap 180 is reversed in this manner. The downwardly moving handle 880 causes the switch 882 (e.g., a nip roller switch) to energize, thereby signaling to the control system 846 that a strap path is clear for automatic feeding.

One or more sensors can be used to determine whether the strap path is clear. For example, a proximity sensor can be positioned to determine a presence of any portion of the strap 180 within the feeding assembly 500. Sensors can be used to detect other measurable parameters (e.g., line speed, presence of any strap inside the strap exchanger 170, position of straps, and the like) and to send at least one signal indicative of the measurable parameter(s). In some embodiments, a sensor 930 (FIG. 5) is used determine whether a strap is within the strap exchanger 170, determine the amount of the strap within the strap exchanger 170, or the like. The sensor 930 can be a mechanical sensor (e.g., a mechanical switch), an optical sensor (e.g., photocell sensor), proximity sensor, or other type of suitable sensing device. The control system 846 is communicatively coupled to the sensor 930 such that the strap holder assembly 502 feeds the strap 182 when the strap 180 is discharged from the strap feeding assembly 500.

In some embodiments, after a short delay (e.g., at least 5 seconds, 10 seconds, etc.) to allow a strap tail 910 (FIG. 14) to exit the feeding assembly 500, the strap exchanger 160 cycles as detailed above and another automatic feed sequence is initiated after which the strapping system 100 begins applying the upper strap 182 to objects.

Prior to depletion of the upper spool 202, the operator can load the empty lower spool 200 with a new strap coil, feed the free end of the strap coil through the strap exhausted switch assembly 450, and insert the free end of the strap into the strap exchanger 160 in preparation for the depletion of the upper spool 202. The upper spool 202 can be nearly depleted when the lower spool 200 is loaded, thus enabling the operator to reload the upper spool 202 after the lower coil has been automatically fed into the strapping unit 120. In some embodiments, the lower spool 200 is loaded with another strap coil immediately after the strap 180 is ejected from the strapping unit 120, thereby reducing machine downtime associated with the reloading process. These loading procedures thus ensure maximum operational flexibility with two spools 200, 202.

Additional strap dispensers can also be used to deliver straps to the strapping unit 120. In some embodiments, another strap dispenser is positioned adjacent to the illustrated strap dispenser 110. Once the strap 182 is routed through the strapping unit 120, a strap from the additional strap dispenser can be loaded into the strap exchanger 160. The strapping unit 120 can bundle objects using the strap 182 while the strap from another dispenser is ready for a feed sequence.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A method of delivering a first strap and a second strap to a strapping system for bundling objects, comprising:

delivering a first strap to a strap holder assembly of a strap exchanger, the strap exchanger fixedly coupled to a frame of the strapping system;

delivering the first strap to a strap feeding assembly of the strap exchanger by moving the strap holder assembly carrying the first strap towards the strap feeding assembly;

moving the strap holder assembly away from the strap feeding assembly while the strap feeding assembly physically engages the first strap;

releasing the first strap from the strap holder assembly while the strap feeding assembly physically engages the first strap; and delivering a second strap to the strap holder assembly after releasing the first strap.

2. The method of claim 1, wherein delivering the first strap to the strap holder assembly includes positioning a section of the first strap between a reciprocating main body of the strap holder assembly and a clamp pivotally coupled to the main body.

3. The method of claim 1, further comprising:

providing a strap guard between an end of the first strap carried by the strap holder assembly and the strap feeding assembly; and moving the strap guard away from the end of the first strap to provide an unobstructed path from the end of the first strap to an entrance of the strap feeding assembly prior to delivering the first strap to the strap feeding assembly.

4. The method of claim 3, wherein moving the strap guard includes moving a portion of the strap guard at least partially surrounding the end of the first strap away from a processing path along which the end of the first strap travels when delivering the first strap to the strap feeding assembly.

5. The method of claim 1, wherein delivering the first strap to the strap feeding assembly includes inserting an end of the first strap between a pair of rollers of the strap feeding assembly.

6. The method of claim 1, further comprising:

delivering the first strap to another component of the strapping system using the strap feeding assembly while delivering the second strap to the strap holder assembly.

7. The method of claim 1, wherein delivering the first strap to the strap holder assembly includes positioning the first strap within the strap holder assembly such that an end of the first strap projects outwardly from the strap holder assembly towards the strap feeding assembly.

8. The method of claim 1, wherein delivering the first strap to the strap feeding assembly includes inserting a free end of the first strap between a drive wheel of the strap feeding assembly and a nip roller of the strap feeding assembly.

9. The method of claim 1, further comprising:

delivering at least a portion of the first strap to another component of the strapping system using the strap feeding assembly while the strap holder assembly holds the second strap.

10. The method of claim 1, further comprising:

accumulating at least a portion of the first strap in an accumulator of the strapping system while the second strap is held by the strap holder assembly.

11. The method of claim 1, wherein delivering the first strap to the strap feeding assembly includes moving an end of the first strap into physical contact with the strap feeding assembly configured to pull the first strap through the strapping system.

12. The method of claim 1, wherein releasing the first strap from the strap holder assembly includes moving a clamp from a closed position in which the clamp holds the first strap to an open position in which the strap is allowed to move away from the strap holder assembly.

13. The method of claim 12, wherein moving the clamp from the closed position to the open position includes pivoting a portion of the clamp below the first strap away from a reciprocating main body of the strap holder assembly that is positioned above the first strap.

14. The method of claim 1, further comprising:

removing the first strap from the strap feeding assembly;

delivering the second strap to the strap feeding assembly using the strap holder assembly carrying the second strap; and releasing the second strap from the strap holder assembly while the strap feeding assembly retains the second strap.

15. A method of delivering a first strap and a second strap to a strapping system, comprising:

delivering a first strap to a strap feeding assembly of the strapping system;

delivering a second strap to a strap exchanger of the strapping system while the strap exchanger is in a strap receiving position;

moving the first strap through the strap feeding assembly to a track assembly adapted to bundle objects using the first strap;

removing the first strap from the strap feeding assembly; and delivering the second strap carried by the strap exchanger to the strap feeding assembly by moving the strap exchanger from the strap receiving position to a strap delivery position after removing the first strap from the strap feeding assembly.

16. The method of claim 15, further comprising:

holding an end of the second strap between a strap holder assembly of the strap exchanger and the strap feeding assembly while moving the first strap through the strap feeding assembly to the track assembly.

17. A method of delivering a plurality of straps to a feeding assembly of a strapping machine for bundling objects, the method comprising:

delivering the plurality of straps to the feeding assembly by repeatedly reciprocating a strap holder assembly to load the strap holder assembly with a respective one of the plurality of straps and to delivery the respective strap to the feeding assembly when the feeding assembly is empty; and repeatedly moving the strap holder assembly until the plurality of straps have been delivered to the feeding assembly.

18. The method of claim 17, further comprising:

after delivering the respective one of the plurality of straps to the feeding assembly, moving another one of the plurality of straps through an accumulator and to a track assembly capable of bundling objects using the another one of the plurality of straps.

19. The method of claim 17, wherein delivering the plurality of straps to the feeding assembly includes delivering the respective one of the plurality of straps to the strap holder assembly while another one of the plurality of straps is positioned within the feeding assembly.

20. The method of claim 17, further comprising:

successively delivering the plurality of straps from a dispenser to the strap holder assembly, the dispenser including a plurality of rotatable spools, each of the rotatable spools carries one of the plurality of straps.

* * * * *